US010197298B2

(12) United States Patent
Jeong

(10) Patent No.: US 10,197,298 B2
(45) Date of Patent: Feb. 5, 2019

(54) INDOOR DEVICE FOR CASSETTE TYPE AIR CONDITIONER

(71) Applicant: LG ELECTRONICS INC., Seoul (KR)

(72) Inventor: Changhoon Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 873 days.

(21) Appl. No.: 14/505,190

(22) Filed: Oct. 2, 2014

(65) Prior Publication Data

US 2015/0093983 A1 Apr. 2, 2015

(30) Foreign Application Priority Data

Oct. 2, 2013 (KR) ..... 10-2013-0117978

(51) Int. Cl.

| | |
|---|---|
| ***F24F 7/08*** | (2006.01) |
| ***F24F 13/10*** | (2006.01) |
| ***F24F 7/10*** | (2006.01) |
| ***F24F 13/08*** | (2006.01) |
| *F24F 1/00* | (2011.01) |

(52) U.S. Cl.

CPC ..... *F24F 7/08* (2013.01); *F24F 1/0014* (2013.01); *F24F 7/10* (2013.01); *F24F 13/084* (2013.01); *F24F 13/10* (2013.01); *F24F 2001/0037* (2013.01)

(58) Field of Classification Search

USPC ..... 454/248, 283, 292, 297, 296, 331, 332; 62/259.1

See application file for complete search history.

(56) References Cited

U.S. PATENT DOCUMENTS

| | | | |
|---|---|---|---|
| 5,642,608 | A | 7/1997 | Sanderson |
| 5,746,655 | A | 5/1998 | Lee |
| 5,769,710 | A | 6/1998 | Kim |
| 5,775,989 | A | 7/1998 | Choi |
| 5,788,570 | A | 8/1998 | Cho |
| 5,943,872 | A | 8/1999 | Sakurada et al. |
| 6,089,972 | A | 7/2000 | Gunii |
| 6,250,373 | B1 | 6/2001 | Vecchi |
| 6,264,552 | B1 | 7/2001 | Oya |

(Continued)

FOREIGN PATENT DOCUMENTS

| | | |
|---|---|---|
| CN | 2420551 | 2/2001 |
| CN | 1478188 | 2/2004 |

(Continued)

OTHER PUBLICATIONS

European Search Report issued in Application No. 14188794.3 dated Jun. 24, 2015.

(Continued)

*Primary Examiner* — Gregory Huson
*Assistant Examiner* — Elizabeth M May
(74) *Attorney, Agent, or Firm* — Ked & Associates LLP

(57) ABSTRACT

An indoor device for a cassette type air conditioner is provided. In the indoor device for the cassette type air conditioner, an outer edge of a suction grill extends to form inner lines of a plurality of discharge holes of a panel, and the suction grill may be opened while slidably moving without interfering with the panel according to a shape thereof.

26 Claims, 14 Drawing Sheets

(56) References Cited

U.S. PATENT DOCUMENTS

| | | | | |
|---|---|---|---|---|
| 6,393,856 | B1 * | 5/2002 | Gunji | F24F 1/0011 62/259.1 |
| 6,598,413 | B2 | 7/2003 | Asahina et al. | |
| 6,692,349 | B1 | 2/2004 | Brinkerhoff et al. | |
| 7,878,017 | B2 | 2/2011 | Yasutomi | |
| 7,908,879 | B1 | 3/2011 | Chen | |
| 7,992,794 | B2 | 8/2011 | Leen et al. | |
| 8,230,693 | B2 | 7/2012 | Tsuji | |
| 8,393,550 | B2 | 3/2013 | Simon et al. | |
| 8,511,108 | B2 | 8/2013 | Yabu | |
| 8,715,047 | B2 | 5/2014 | Kim | |
| 8,740,101 | B2 | 6/2014 | Leen et al. | |
| 8,746,583 | B2 | 6/2014 | Simon et al. | |
| 9,410,714 | B2 | 8/2016 | Tsuji | |
| 9,574,781 | B2 | 2/2017 | Tsuji | |
| 2001/0054493 | A1 | 12/2001 | Hatanaka | |
| 2003/0157883 | A1 | 8/2003 | Kwak | |
| 2004/0166797 | A1 | 8/2004 | Thrasher et al. | |
| 2005/0053465 | A1 | 3/2005 | Roach et al. | |
| 2005/0109047 | A1 | 5/2005 | Park et al. | |
| 2007/0066215 | A1 | 3/2007 | Song et al. | |
| 2007/0261425 | A1 | 11/2007 | Yasutomi | |
| 2009/0077987 | A1 | 3/2009 | Egawa | |
| 2009/0199583 | A1 | 8/2009 | Jeon et al. | |
| 2010/0006660 | A1 | 1/2010 | Leen et al. | |
| 2010/0192610 | A1 | 8/2010 | Yoshitake et al. | |
| 2010/0193592 | A1 | 8/2010 | Simon et al. | |
| 2010/0225012 | A1 | 9/2010 | Fitton et al. | |
| 2010/0226801 | A1 | 9/2010 | Gammack | |
| 2010/0287966 | A1 * | 11/2010 | Cha | F24F 1/0007 62/263 |
| 2011/0048057 | A1 | 3/2011 | Lee et al. | |
| 2011/0137467 | A1 | 6/2011 | Leen et al. | |
| 2011/0319009 | A1 | 12/2011 | Nam | |
| 2012/0003917 | A1 | 1/2012 | Jeong | |
| 2012/0033952 | A1 | 2/2012 | Wallace et al. | |
| 2012/0214399 | A1 | 8/2012 | Tsuji | |
| 2012/0220212 | A1 | 8/2012 | Tsuji | |
| 2012/0288363 | A1 | 11/2012 | Yumoto et al. | |
| 2013/0186964 | A1 | 7/2013 | Simon et al. | |
| 2013/0280099 | A1 | 10/2013 | Park et al. | |
| 2014/0026604 | A1 | 1/2014 | Yoshimura | |

FOREIGN PATENT DOCUMENTS

| | | | | |
|---|---|---|---|---|
| CN | 1499141 | | 5/2004 | |
| CN | 1517613 | | 8/2004 | |
| CN | 1573239 | | 2/2005 | |
| CN | 1712808 | | 12/2005 | |
| CN | 1727764 | | 2/2006 | |
| CN | 101464041 | | 6/2009 | |
| CN | 201368569 | | 12/2009 | |
| CN | 101761986 | | 6/2010 | |
| CN | 101796349 | | 8/2010 | |
| CN | 102478304 | | 5/2012 | |
| CN | 102575869 | | 7/2012 | |
| CN | 202630252 | | 12/2012 | |
| EP | 0884542 | A1 * | 12/1998 | F24F 1/58 |
| EP | 0 926 451 | | 6/1999 | |
| EP | 1 003 002 | A2 | 5/2000 | |
| EP | 1 152 193 | | 11/2001 | |
| EP | 1271065 | A2 | 1/2003 | |
| EP | 1 326 055 | A1 | 7/2003 | |
| EP | 1 482 252 | A2 | 12/2004 | |
| EP | 1 533 577 | A1 | 5/2005 | |
| EP | 1 548 375 | A1 | 6/2005 | |
| EP | 1 813 875 | A1 | 8/2007 | |
| EP | 1 816 406 | A2 | 8/2007 | |
| EP | 1 837 607 | A2 | 9/2007 | |
| EP | 1 947 397 | A1 | 7/2008 | |
| EP | 2 017 542 | A1 | 1/2009 | |
| EP | 2023049 | A2 | 2/2009 | |
| EP | 2 199 695 | A1 | 6/2010 | |
| EP | 2 363 653 | A2 | 9/2011 | |
| EP | 2 498 018 | A1 | 9/2012 | |
| EP | 2 530 395 | A1 | 12/2012 | |
| EP | 3 006 840 | | 4/2016 | |
| JP | S58-173320 | A | 10/1983 | |
| JP | H11-148698 | A | 6/1999 | |
| JP | 2001-173982 | A | 6/2001 | |
| JP | 2002-228183 | A | 8/2002 | |
| JP | 2003-042515 | | 2/2003 | |
| JP | 2003-065558 | A | 3/2003 | |
| JP | 2004-138363 | A | 5/2004 | |
| JP | 2009-168347 | | 7/2009 | |
| JP | 2012-220110 | A | 11/2012 | |
| JP | 3183736 | U | 5/2013 | |
| KR | 1996-0004920 | | 6/1996 | |
| KR | 20-0161129 | | 11/1999 | |
| KR | 10-2000-0035591 | A | 6/2000 | |
| KR | 10-2005-0083664 | A | 8/2005 | |
| KR | 10-0583415 | B1 | 5/2006 | |
| KR | 10-2006-0062148 | | 6/2006 | |
| KR | 10-2007-0058682 | A | 6/2007 | |
| KR | 10-2007-0095141 | | 9/2007 | |
| KR | 10-0794596 | B1 | 1/2008 | |
| KR | 10-2008-0075632 | A | 8/2008 | |
| KR | 10-2007-0080383 | A | 2/2009 | |
| KR | 10-2010-0036919 | | 4/2010 | |
| KR | 20-2012-0001065 | U | 2/2012 | |
| KR | 10-2012-0082934 | A | 7/2012 | |
| WO | WO 2004/011854 | A1 | 2/2004 | |
| WO | WO 2004/040204 | | 5/2004 | |

OTHER PUBLICATIONS

U.S. Office Action dated Oct. 20, 2016 issued in U.S. Appl. No. 14/508,161.
Chinese Office Action dated Oct. 13, 2016.
Chinese Office Action dated Nov. 7, 2016.
Chinese Office Action dated Nov. 9, 2016 issued in Application No. 201410270547.3 (Translation).
Chinese Office Action dated Nov. 9, 2016 issued in Application No. 201410495092.5 (Translation).
U.S. Office Action issued in U.S. Appl. No. 14/508,161 dated Mar. 16, 2017.
Chinese Office Action dated Feb. 23, 2017 (English Translation).
European Search Report dated Feb. 24, 2015 issued in Application No. 14186801.8.
European Search Report issued in Application No. 14185283.0 dated Feb. 4, 2015.
European Search Report issued in Application No. 14185285.5 dated Feb. 4, 2015.
European Search Report issued in Application No. 14187785.2 dated Feb. 4, 2015.
U.S. Office Action issued in U.S. Appl. No. 14/510,599 dated Jun. 30, 2017.
U.S. Office Action issued in U.S. Appl. No. 14/504,823 dated Jul. 25, 2017.
U.S. Appl. No. 14/504,823, filed Oct. 2, 2014.
U.S. Appl. No. 14/508,161, filed Oct. 7, 2014.
U.S. Appl. No. 14/510,599, filed Oct. 9, 2014.
U.S. Appl. No. 14/510,340, filed Oct. 9, 2014.
Chinese Office Action dated Jul. 19, 2017 (English Translation).
United States Office Action dated Feb. 28, 2018 issued in co-pending U.S. Appl. No. 14/510,599.
United States Office Action dated Dec. 14, 2017 issued in co-pending related U.S. Appl. No. 14/504,823.
U.S. Office Action issued in U.S. Appl. No. 14/510,340 dated Feb. 7, 2018.
U.S. Office Action issued in U.S. Appl. No. 14/508,161 dated Feb. 9, 2018.
U.S. Appl. No. 14/510,599, filed Oct. 9, 2014, Martha M. Becton.
U.S. Appl. No. 14/510,340, filed Oct. 9, 2014, Martha M. Becton.
U.S. Notice of Allowance issued in U.S. Appl. No. 14/510,340 dated Oct. 5, 2018.

* cited by examiner

INDOOR DEVICE FOR CASSETTE TYPE AIR CONDITIONER

CROSS-REFERENCE TO RELATED APPLICATION(S)

The present application claims priority under 35 U.S.C. 119 and 35 U.S.C. 365 to Korean Patent Application No. 10-2013-0117978, filed in Korea on Oct. 2, 2013, which is hereby incorporated by reference in its entirety.

BACKGROUND

1. Field

An indoor device for a cassette type air conditioner is disclosed herein.

2. Background

In general, air conditioners are cooling/heating systems in which indoor air is suctioned in and heat-exchanged with a low or high-temperature refrigerant, and then the heat-exchanged air is discharged into an indoor space to cool or heat the indoor space. The above-described processes are repeatedly performed. Air conditioners may generate a series of cycles using a compressor, a condenser, an expansion valve, and an evaporator.

In particular, such an air conditioner may include an outdoor unit or device (which is called an "outdoor side" or "heat dissipation side"), which is generally installed in an outdoor space, and an indoor unit or device (which is called an "indoor side" or "heat absorption side"), which is generally installed in a building. The outdoor device may include a condenser, that is, an outdoor heat exchanger, and a compressor, and the indoor device, that is, an indoor heat exchanger, may include an evaporator.

As is well known, air conditioners may be divided into spilt type air conditioners with outdoor and indoor devices, which are installed separately from each other, and integrated type air conditioners with outdoor and indoor devices, which are integrally installed with each other. When considering a space in which the air conditioner is to be installed or noise, the spilt type air conditioner may be preferable.

In a multi type air conditioner of such a spilt type air conditioner, a plurality of indoor devices may be connected to one outdoor device. Thus, as the plurality of indoor devices may be respectively installed in indoor spaces for air-conditioning, an effect as if a plurality of air conditioners are installed may be achieved.

Hereinafter, an indoor device for a cassette type air conditioner in a general multi type air conditioner will be described with reference to the accompanying drawing.

FIG. 1 is a perspective view illustrating an exterior of an indoor device for a cassette type air conditioner according to the related art. As illustrated in FIG. 1, an indoor unit or device 1 may be maintained in a state in which an upper portion of the indoor unit 1 is fixed to an inside of a ceiling and hung on the ceiling, and a bottom surface is exposed to a lower side of the ceiling to suction in indoor air and then to discharge the suctioned air into the indoor space. In the indoor device 1, as most of the main body is disposed in the ceiling, only a panel 10 and suction grill 20 may be viewable when a user looks up toward the ceiling.

The panel 10 may define an exterior edge of the bottom surface of the indoor device 1. A suction hole 11, which may be provided in a square shape, may be defined in a central portion of the panel 10 to guide introduction of the indoor air into the indoor device 1. A plurality of discharge holes 12, which may be provided to guide the air so that the air conditioned in the indoor device 1 may be discharged again into the indoor space, may be defined outside of the suction hole 11. A vane 13 to adjust a flow direction of the discharged air may be rotatably disposed inside each discharge hole 12.

The suction grill 20, which may have approximately square plate shape and in which a plurality of holes through which air may pass may be defined, may be mounted on the central portion of the front panel 10, that is, inside the suction hole 11. The suction grill 20 may be configured to filter foreign substances contained in the air introduced into the indoor device 1 through the suction hole 11. An air filter 30 may be disposed above the suction grill 20.

The air filter 30 may be separably mounted on the suction grill 20 so as to provide for easy cleaning where foreign substances collect on the air filter 30 when the indoor device 1 is used for a long period of time. Also, the suction grill 20 may be selectively opened so that the air filter 30 may be easily separated therefrom.

That is, the suction grill 20 may be rotatably coupled to an end or edge of the panel 10. In more detail, a first end of the suction grill 20 and an inner surface of the suction hole 11 may be coupled to each other by a hinge 21. The suction grill 21 may rotate downward with respect to the hinge 21 to selectively open an inside of the indoor device 1, as illustrated in FIG. 1.

A switching button 14, which may be manipulated by a user when the suction grill 20 is opened or closed, may be disposed on a surface of the front panel 10. The switching button 14 may interfere with a second end of the suction grill 20 by an elastic restoring force thereof to prevent the suction grill 20 from rotating. When the switching button 14 is pushed, the interference with the second end of the suction grill 20 may be released, and thus, the suction grill 20 may rotate with respect to the hinge 21.

However, the indoor device 1 according to the related art may have following limitations.

The suction grill 20 may be seated on the inside of the suction hole 11 of the panel 10 and have a structure that is rotatable using the hinge 21 as an axis. In the above-described structure, although the suction grill 20 may be rotatably opened or closed, the suction grill 20 may be limited in shape or coupling structure thereof. That is, if the suction grill 20 covers the panel 10 without being inserted into the panel 10, or the panel 10 has edges or both ends of each front end which protrude from the central portion thereof, as the suction grill 20 may interfere with the edges or ends when being rotated, it may be difficult to rotatably mount the suction grill 20 on the panel 10.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. The embodiments may, however, be embodied in many different forms and should not be construed as being limited to the embodiments set forth herein; rather, alternate embodiments included in other retrogressive inventions or falling within the spirit and scope will fully convey the concept to those skilled in the art.

Figure 1:
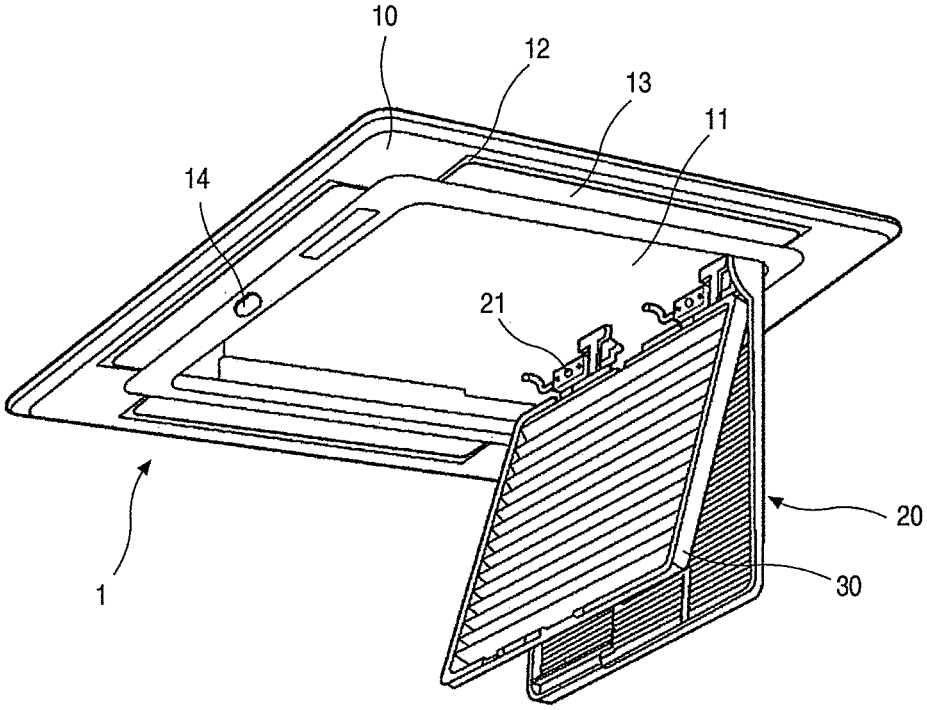
Fig.1 RELATED ART
FIG. 1 is a perspective view of an indoor device for a cassette type air conditioner according to a related art.
Figure 2:
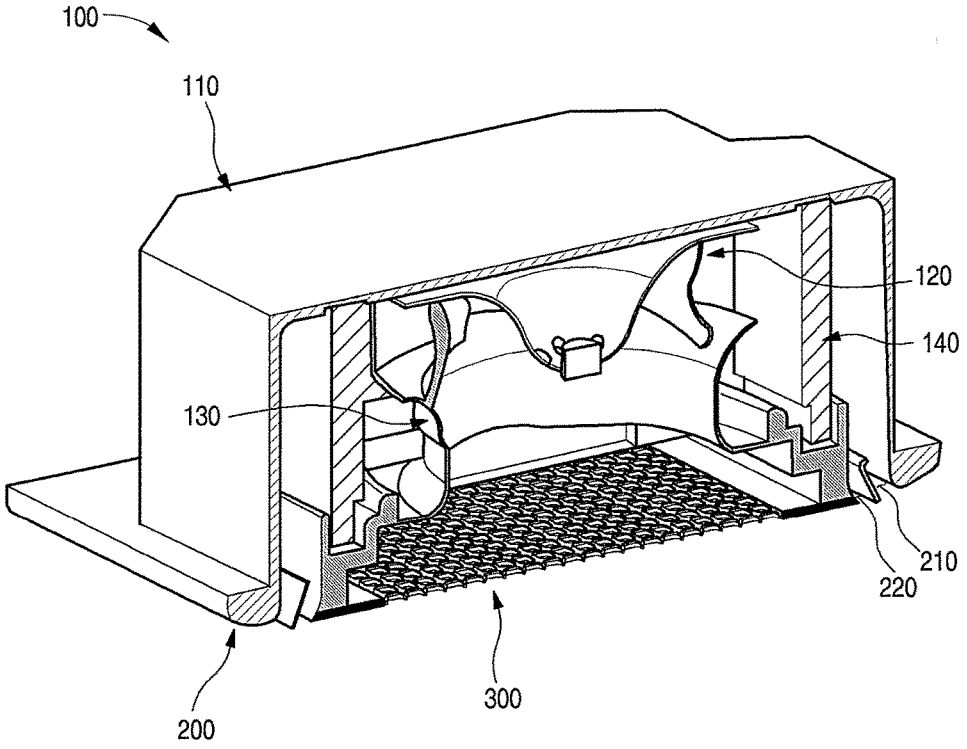
FIG. 2 is a schematic cutoff perspective view of an indoor device for a cassette type air conditioner according to an embodiment.

FIG. 2 is a schematic cutoff perspective view of an indoor device for a cassette type air conditioner according to an embodiment. Referring to FIG. 2, an indoor unit or device 100 for an air conditioner (hereinafter, referred to as an "indoor device") according to embodiments may include a cabinet 110 inserted into a ceiling in an indoor space, and a panel 200 and a suction grill 300, which may be disposed on or at a lower end of the cabinet 110 to define an outer appearance of a bottom surface of the indoor device 100 and may be exposed in the ceiling when the indoor device 100 is installed. A heat exchanger 140 that heat-exchanges with suctioned air, a blower fan 120 to forcibly suction in and discharge indoor air, and an air guide 130 having a bell-mouth shape to guide the suctioned air toward the blower fan 120 may be provided in the cabinet 110.

The panel 200 may be mounted on the lower end of the cabinet 110 and have an approximately rectangular shape when viewed from a lower side thereof. Also, the panel 200 may protrude outward from the lower end of the cabinet 110 so that a circumferential portion of the panel 200 may be in contact with the ceiling.

At least one discharge hole 210 that serves as an outlet, through which the air may be discharged from the cabinet 110, may be provided in the panel 200. A discharge hole 210 may be defined at a position corresponding to each side of the panel 200. Each discharge hole 210 may be defined along a longitudinal direction of each side of the panel 200. Each discharge hole 210 may be opened or closed by a vane 220 mounted on the panel 200.

The suction grill 300 may be mounted on or at a central portion of the panel 200. The suction grill 300 may define an exterior of a bottom surface of the indoor device 100. The suction grill 300 may provide a passage for air introduced into the indoor device 100. At least a portion of the suction grill 300 may have a grill or lattice shape so that the indoor air may be smoothly introduced.

Hereinafter, structures of the panel 200 and the suction grill 300 according to embodiments will be discussed in detail hereinbelow.

Figure 3:
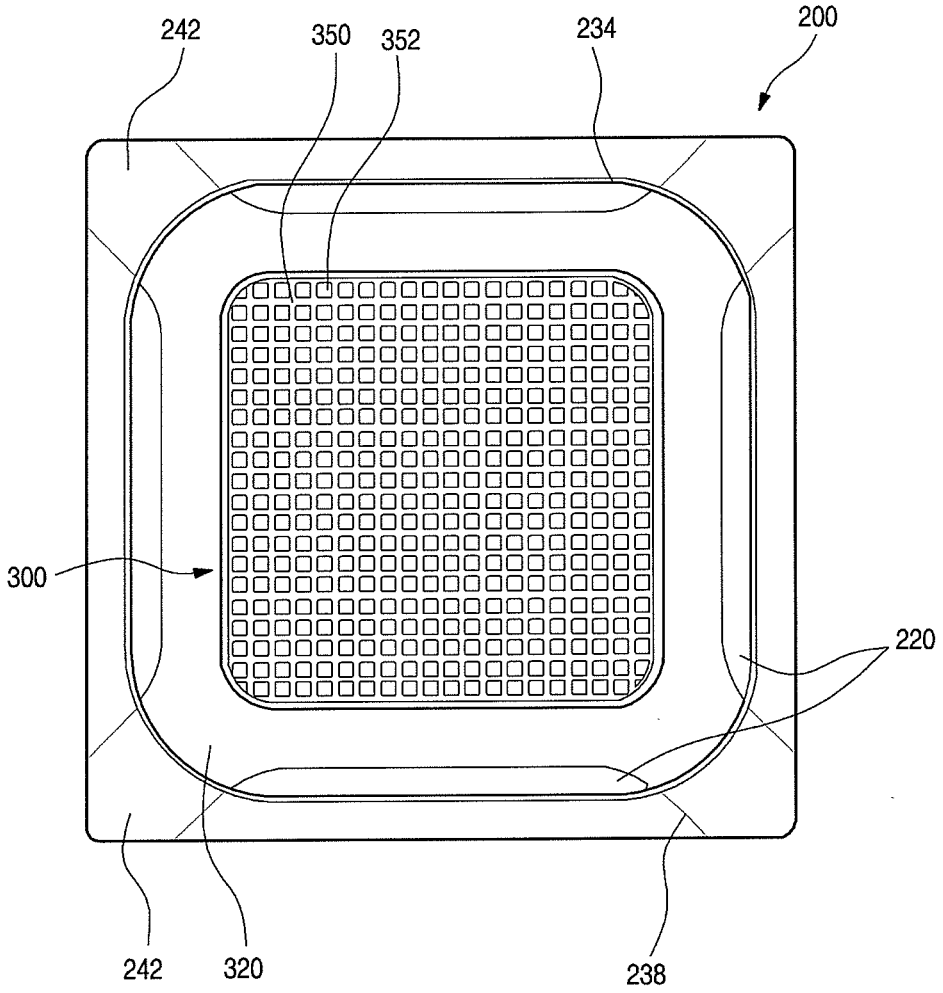
FIG. 3 is a bottom view of the indoor device for a cassette type air conditioner of FIG. 2.
Figure 4:
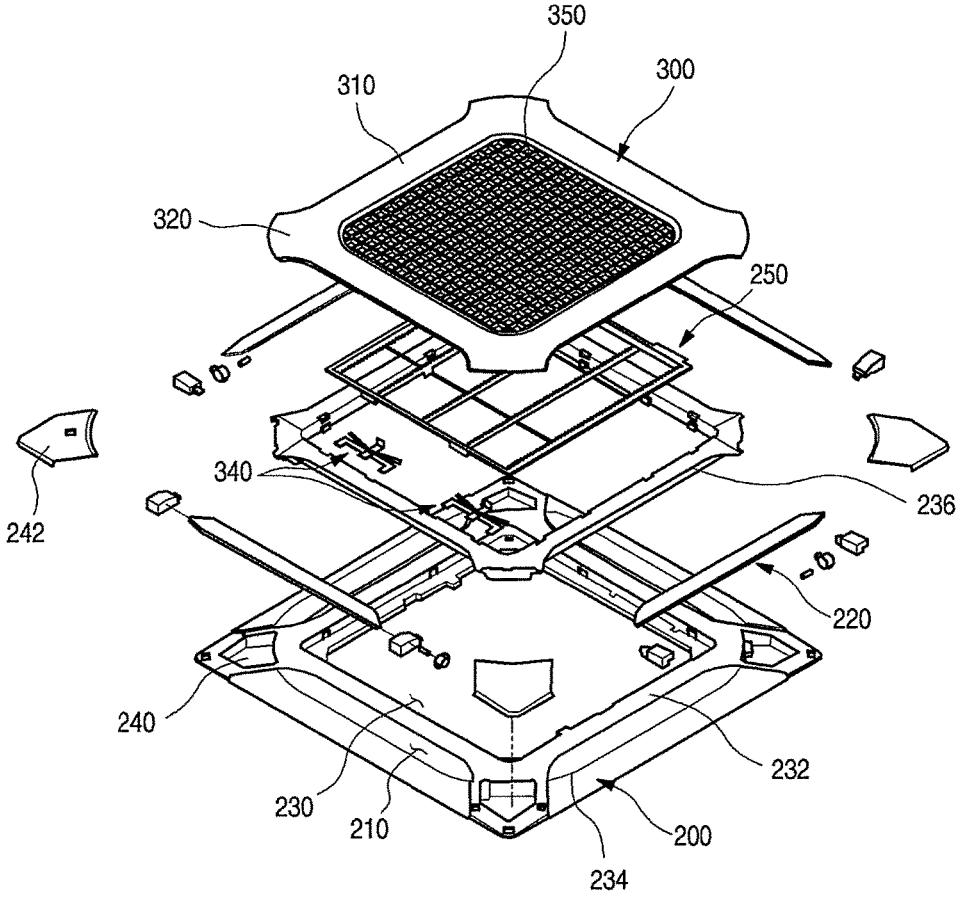
FIG. 4 is an exploded perspective view of a main portion of the indoor device for a cassette type air conditioner of FIG. 2.
Figure 5:
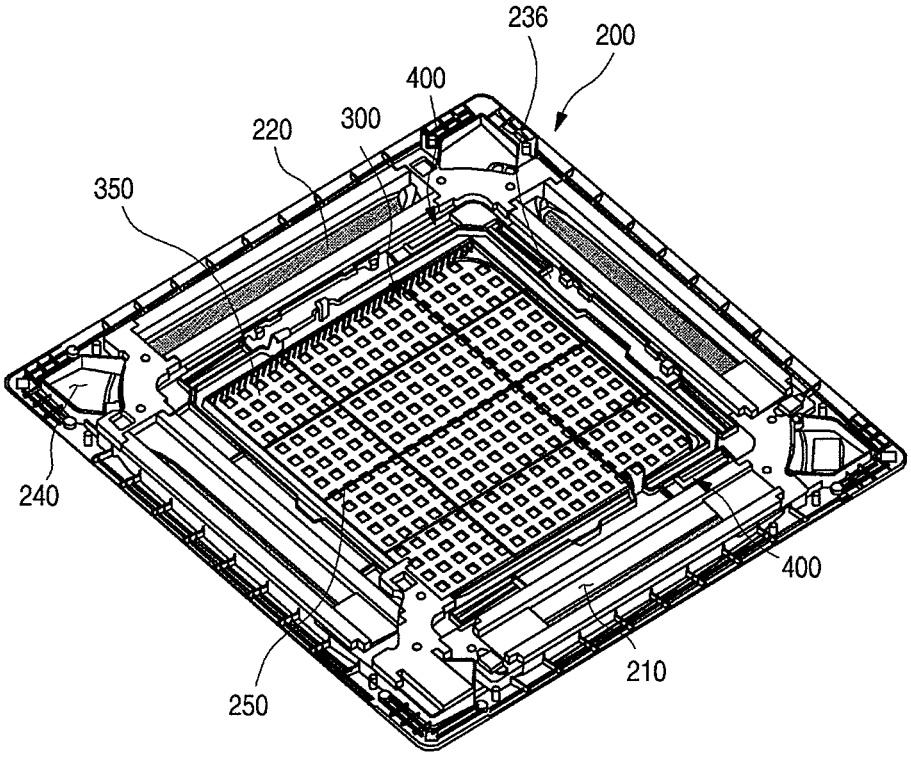
FIG. 5 is a view illustrating a state in which a panel and a suction grill of the indoor device for a cassette type air conditioner of FIG. 2 are coupled to each other according to embodiments.
Figure 6:
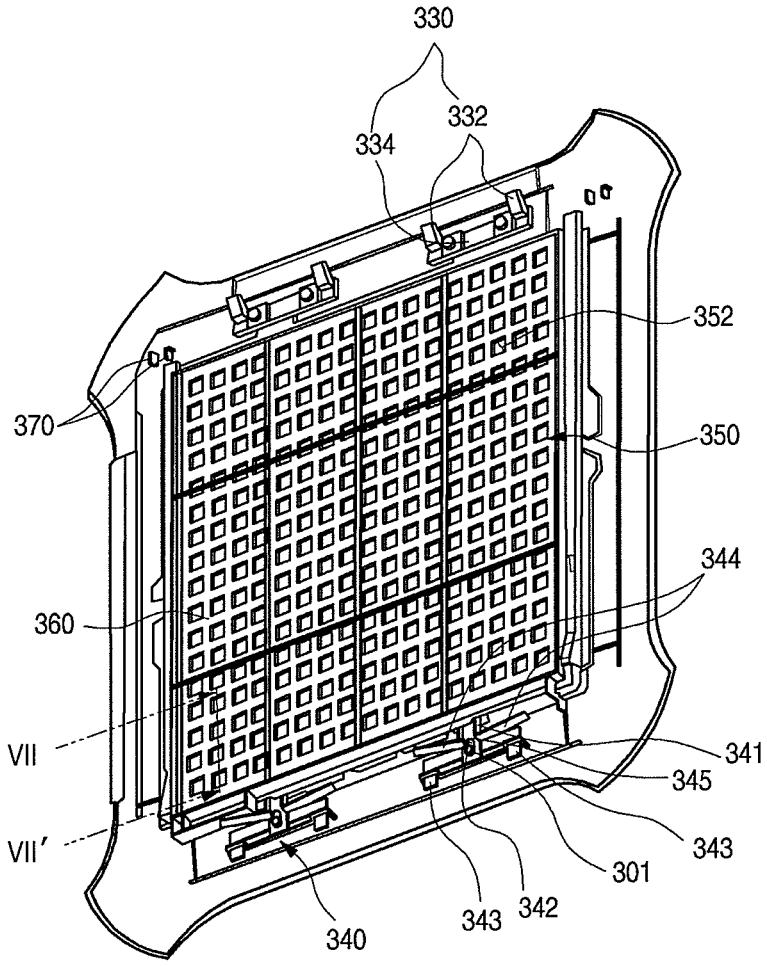
FIG. 6 is a perspective view illustrating an inner structure of the suction grill according to embodiments.

FIG. 3 is a bottom view of the indoor device for a cassette type air conditioner of FIG. 2. FIG. 4 is an exploded perspective view of a main portion of the indoor device for a cassette type air conditioner of FIG. 2. FIG. 5 is a view illustrating a state in which the panel and the suction grill of the indoor device for a cassette type air conditioner of FIG. 2 are coupled to each other. FIG. 6 is a perspective view illustrating inner structure of the suction grill according to embodiments.

As illustrated in FIG. 2, the panel 200 may have an approximately rectangular plate shape. A suction hole 230 may be provided in a central portion of the panel 200. The suction hole 230 may be configured to suction in the indoor air. The suction hole 230 may have a square shape and a size slightly less than a size of the suction grill 300.

The discharge hole(s) 210 may be defined outside of the suction hole 230. The discharge hole(s) 210 may be provided at each of four sides. Both ends of each discharge hole 210 may have a curved shape having a width that gradually decreases towards ends thereof.

A grill seat 232 may be disposed outside of the suction hole 230. The grill seat 232 may be stepped to support the suction grill 300. A panel-side mount 260, on which a connection member 400 that will be discussed hereinbelow may be mounted, may be disposed on the grill seat 232.

A circumference of the grill seat 232 may have a closed loop shape that generally defines an outer line of each discharge hole 210. A rounded groove 234 may be defined around the grill seat 232 in a state in which the suction grill 300 is mounted. The rounded groove 234 may have a square shape having four rounded edges. Also, the four rounded edges of the rounded groove 234 may define a line corresponding to an outer line of the suction grill 300, so that vanes 220 of the discharge hole(s) 210, the suction grill 300, and the panel 200 may provide a sense of unity on the whole. Also, the rounded groove 234 may have a predetermined rounded or inclined cross-section so that discharged air does not flow along the panel 200, thereby preventing the ceiling from being wetted or contaminated by air discharged from the discharge hole(s) 210.

The discharge hole(s) 210 may be opened or closed by the vane(s) 220. A motor may be disposed on an end of each vane 220. Thus, the vane 220 may be rotated by the motor to adjust a flow direction of the discharged air.

Each vane 220 may have a shape corresponding to a shape of a respective discharge hole 210 to cover the discharge hole 210. Also, ends of the vane 220 may have a width that gradually decreases towards ends thereof, similar to the discharge hole 210. When the vane 220 is closed, an outer edge of the vane 220 may extend along the rounded groove 234 to contact the panel 200, and an inner edge of the vane 220 may contact a concave portion 310 of the suction grill 300.

An inspection hole 240 may be provided in each of the four edges of the panel 200. The inspection hole 240 may provide a space to fix and install the panel 200. The inspection hole 240 may be opened or closed by a corner cover 242 so as to receive service to electric components mounted on a back surface of the panel 200 or confirm an operation of the indoor device 100. An inspection hole 240 and a corner cover 242 may be disposed on each of the four edges of the panel 200 or be disposed on at least one of the four edges.

An end of the corner cover 242 may be disposed to face an end of protrusion 320 of the suction grill 300 with respect to a boundary of the rounded groove 234. Each corner cover 242 and protrusion 320 may have lines corresponding to the rounded groove 234 to provide an exterior having a sense of unity.

A separate panel bracket 236 may be mounted on the grill seat 232 of the panel 200. The panel bracket 236 may be configured to reinforce the grill seat 232 and stably support components to mount or open/close the suction grill 300 mounted on the grill seat 232. Alternatively, the panel bracket 236 may not be provided, but rather, the grill seat 232 and the panel bracket 236 may be integrated with each other to allow the grill seat 232 to perform the function of the panel bracket 236.

The suction grill 300 may be mounted on the grill seat 232. In a state in which the suction grill 300 is mounted, a bottom surface of the panel 200 and a bottom surface of the suction grill 300 may be disposed on a same plane to provide a sense of unity.

A concave portion 310 may be defined in each of the sides of the suction grill 300. The concave portion 310 may be disposed at a same position as an inner line of the discharge hole 210. Also, in a state in which the suction grill 300 is mounted, an inner line of the discharge hole 210 and the concave portion 310 may have a same shape. That is, the concave portion 310 may have rounded ends or edges. The concave portion 310 may have a curvature corresponding to shapes of the discharge hole 210 and the vane 220.

Thus, if the suction grill 300 is closed, an inner line of the vane 220 and an end or edge of the suction grill 300 may be adjacent to each other at a same distance. Thus, the suction grill 300 and the panel 200 may provide a sense of unity.

A protrusion 320 may be disposed on each of the four edges of the suction grill 300. Each protrusion 320 may further protrude from the concave portion 310 to define a region between concave portions 310. Each protrusion 320 may be disposed between discharge holes 210 when the suction grill 300 is mounted. Each protrusion 320 may have an end that is rounded at a same curvature as that of the rounded groove 234. Thus, in a state in which the suction grill 300 is mounted, a circumference defined by the suction grill 300 and the vane 220 may have a same shape as the rounded groove 234.

The protrusion 320 may have a same width as the corner cover 242. A side groove 238 defined along the protrusion 320 may extend up to an end or edge of the panel 200 along both sides of the corner cover 242. Also, the side groove 238 may be connected to the concave portion 310 of the suction grill 300 and the inner line of the vane 220.

Thus, in a state in which the indoor device 100 is installed, when viewed from a lower side of the indoor device 100, the rounded groove 234 may be defined in a center, and the side grooves 238 may be defined in each of four sides. Also, shapes of the suction grill 300, the discharge hole 210, and the vane 220 may be defined by the rounded groove 234 and the side grooves 238.

A grill-side mount 370, on which the connection member 400 may be mounted, may be disposed on each of both lateral sides of a top surface of the suction grill 300. The grill-side mount 370 may be disposed outside of a suction portion 350, which will be described hereinbelow. That is, a pair of ribs may extend upward from the grill-side mount 370 to allow the connection member 400 to be rotatably fixed thereto.

A fixing member 330 to fix the suction grill 300 and a switching member 340 to selectively restrict the suction grill 300 may be disposed on front and rear ends of a top surface of the suction grill 300, respectively. Each fixing member 330 may be mounted on or at a rear side of the suction grill 300 as a separate member. Each fixing member 330 may include a pair of protruding fixed pieces 332 to be fixed to the panel 200 or the panel bracket 236, and a coupling plate 334 to connect the pair of fixed pieces 332 to each other and to the suction grill 300. The pair of fixed pieces 332 may be inclined upward. Thus, when the suction grill 300 is pushed backward, the pair of fixed pieces 332 may be inserted into one side of the panel 200 to fix a rear end of the suction grill 300 to the panel 200. On the other hand, when the suction grill 300 is pulled forward, the rear end of the suction grill 300 may be separated from the panel 200. A pair of the fixing members 330 may be provided at both lateral sides of the suction grill 300. The fixing members 300 may be integrated with the suction grill 300. Also, a fixing member insertion portion, in which the fixing member 330 may be inserted, may be defined in the panel 200 or the panel bracket 236 to correspond to each fixing member 330.

Each switching member 340 may be restricted against the panel 200 or the panel bracket 236 so that a front end of the suction grill 300 may be fixed in a state in which the fixing member 330 is inserted into the panel 200 or the panel bracket 236. That is, the switching member 340 may be selectively restricted according to a user's manipulation.

In more detail, each switching member 340 may be disposed on a front portion of the suction grill 300. Also, a pair of switching members 340 may be provided with a distance therebetween that corresponds to the fixing member 330. Also, each switching member 340 may be configured to selectively restrict the panel 200 and the suction grill 300 by elasticity when manipulated by a user. Each switching member 340 may be configured to be manipulated by a user when the suction grill 300 is separated or mounted. Each switching member 340 may have one side exposed to a bottom surface of the suction grill 300 so as to be manipulated. The elasticity to operate the switching member 340 may be provided by the switching member 340 itself or a separate elastic member.

According to this embodiment, the switching member 340 may include a fixed portion 341 fixed to the suction grill 300, a manipulation portion 345 that extends from the fixed portion 342 to move the fixed portion 341 by a user's manipulation, and a plate-shaped elastic portion 344 that extends to each of both sides of the manipulation portion 345 to provide an elastic force when the manipulation portion 345 is manipulated. A guide hole 342 having a long hole shape may be defined in a center of the fixed portion 341. A guide protrusion 301 that protrudes from the suction grill 300 may be inserted into the guide hole 342. Thus, the fixed portion 341 may be moved in forward and backward directions by the guide protrusion 301 and the guide hole 342. An insertion piece 343 that extends in a direction opposite to an extending direction of the manipulation portion 345 may be disposed on each of first and second ends of the fixed portion 341. The insertion piece 343 may be inserted into the panel 200 or the panel bracket 236 when the fixed portion 341 moves to maintain a state in which the suction grill 300 is restricted and mounted on the suction grill 300 and the panel 200 by the switching member 340.

The elastic portion 344 may have a plate shape, which may be curved in a backward direction and extend to both first and second sides. The curved portion of the elastic portion 344 may contact one side of the suction grill 300. Thus, the fixed portion 341 may be maintained in a state in which it moves in a forward direction when the manipulation portion 345 is not manipulated. Also, the insertion piece 343 may be restricted with the panel 200 or the panel bracket 236, and thus, the suction grill 300 may be maintained in a mounted state thereof. Also, when the manipulation portion 345 is manipulated and pulled, the elastic portion 344 may be elastically deformed, and the fixed portion 341 may move in a backward direction. As a result, restriction of the insertion piece 343 may be released to open the suction grill 300.

The manipulation portion 345 may be bent at an end of the fixed portion 341. The manipulation portion 345 may have an end that passes through the suction grill 300 and be exposed to the outside so that a user may manipulate the manipulation portion 345. The manipulation portion 345 may be exposed between grills 360 of the suction grill 300. In this case, a user may insert a finger into a suction hole 352 between the grills 360 to manipulate the manipulation portion 345.

An air filter (not shown) to purify or filter air may be disposed on the upper surface of the suction grill 300. The air filter may be detachably mounted on or to a filter case 250.

The air filter to filter foreign substances and physically or chemically purify suctioned air may be disposed within the filter case 250. The air filter may be separated from the filter case 250, and then, may be replaced after a predetermined time or usable use has elapsed.

The suction portion 350, which may have a lattice shape, may be disposed on or at a center of the suction grill 300. The suction portion 350 may be disposed inside the suction hole 230 of the panel 200 to allow the suctioned air to fully flow into the cabinet 110 through the panel 200.

Hereinafter, a specific shape of the suction grill will be described with reference to the drawings.

Figure 7:
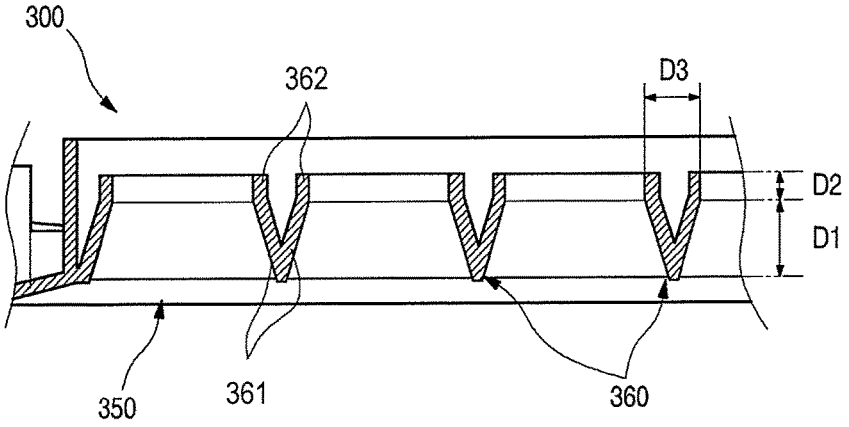
FIG. 7 is a partial cross-sectional view of the suction grill of FIG. 6, taken alone line VII-VII' of FIG. 6.

FIG. 7 is a partial cross-sectional view of the suction grill of FIG. 6, taken along line VII-VII' of FIG. 6. As illustrated in the drawings, the suction portion 350 of the suction grill 300 may have a lattice shape due to a plurality of grills 360, which may be disposed to cross each other in horizontal and vertical directions. Suction holes 352, through which air may be suctioned, may be defined between the plurality of grills 360.

As illustrated in the drawings, each of the plurality of grills 360 may have a cross-section having a shape that gradually decreases in width in a direction toward a bottom surface of the suction grill 300, with reference to FIG. 7. Thus, air suctioned through the suction holes 352 may smoothly flow upward without colliding with each other after passing through the plurality of grills 360. Each of the plurality of grills 360 may have a downwardly recessed shape with an opened top surface. Each grill 360 may have a predetermined space therein. Thus, dust or foreign substances generated above the suction grill 300 may drop and be collected in the space.

The structure of the grill will be described below in detail. The grill 360 may include an inclined portion 361 at a lower portion thereof and a vertical portion 362 that vertically extends upward from an upper end of the inclined portion 361. The inclined portion 361 may be tapered downward to form both inclined side surfaces. Thus, each suction hole 352 may have a wide lower end and a width that gradually decreases as it extends upward.

Also, the vertical portion 362 may extend upward in a direction substantially perpendicular to a bottom surface of the suction grill 300 from an upper end of the inclined portion 361. The inclined portion 361 may have a vertical length D1 less than a length D2 of the vertical portion 362. Also, the inclined portion 361 may have an angle so that the vertical portion 361 has an upper distance D3 greater by at least two times than the length D2 of the vertical portion 362 when comparing the upper end of the inclined portion 361, that is, a horizontal distance D3 of the vertical portion 362 to the horizontal length D2 of the vertical portion 361. Thus, the air passing through the suction hole 352 may be suctioned in a state in which the air is divided at the upper end of the suction holes 352. Thus, the air suctioned through the suction holes 352 may not cause noise due to collision as the air passes through the suction holes 352.

The suction grill 300 may be configured to open or close the panel 200 according to a user's manipulation. When the suction grill 300 is opened or closed, the suction grill 300 may be connected to the panel 200 by the connection member 400, which connects the suction grill 300 to the panel 200. Also, when the suction grill 300 is opened or closed by the connection member 400, the suction grill 300 may slidably move or rotate.

Hereinafter, the connection member 400 and components to mount the connection member 400 will be described in detail hereinbelow.

Figure 8:
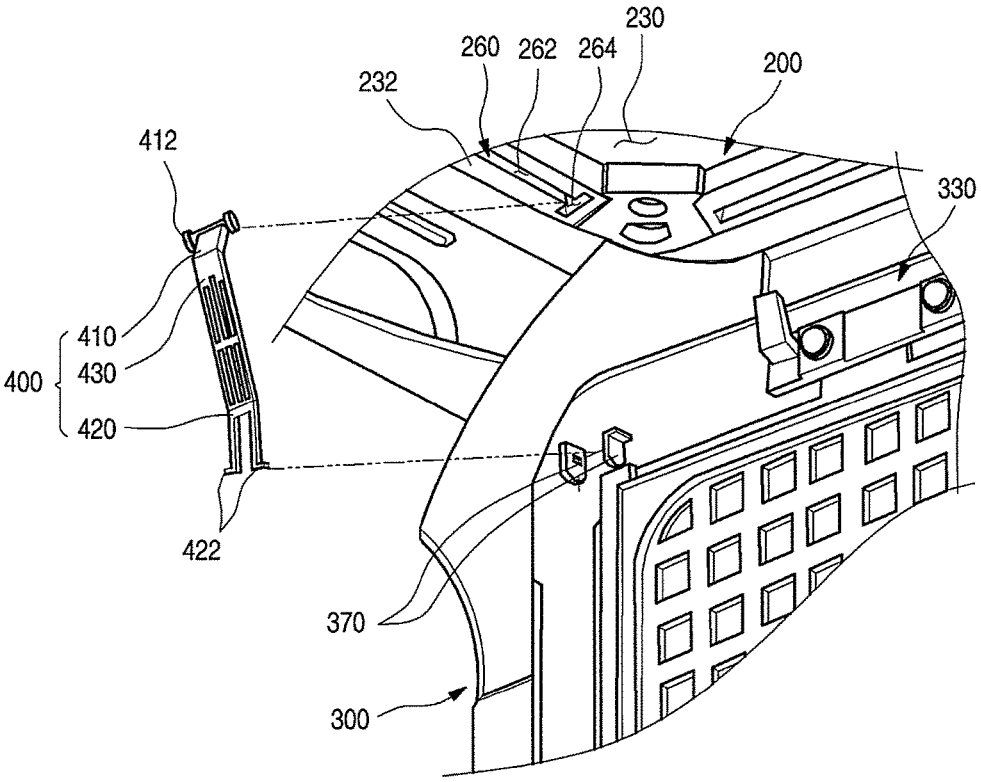
FIG. 8 is an exploded perspective view illustrating a mounted structure of a connection member of the indoor device for a cassette type air conditioner of FIG. 2.
Figure 9:
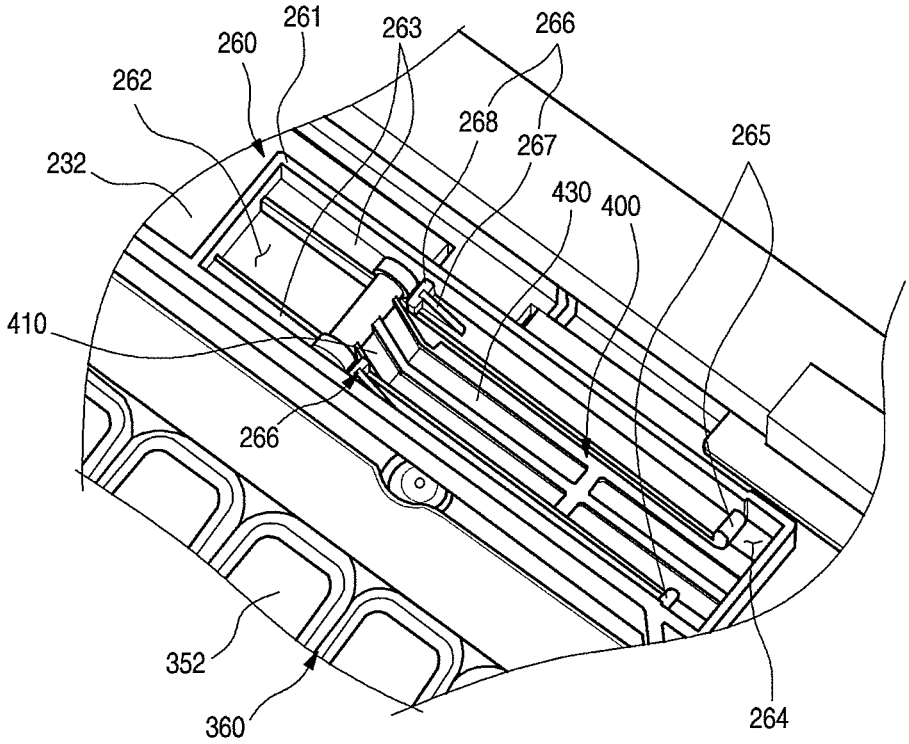
FIG. 9 is a partial perspective view illustrating a state in which the connection member of FIG. 8 is mounted.

FIG. 8 is an exploded perspective view illustrating a mounted structure of a connection member of the indoor device for a cassette type air conditioner of FIG. 2. FIG. 9 is a partial perspective view illustrating a state in which the connection member of FIG. 8 is mounted.

As illustrated in the drawings, the connection member 400 may have both ends respectively mounted on the panel 200 and the suction grill 300. A pair of connection members 400 may be provided on first and second sides to connect the suction grill 300 to the panel 200. For this, the grill-side mount 370 may be disposed on each of first and second sides of the suction grill 300, and the panel-side mount 260 may be disposed on the panel 200.

The grill-side mount 370 may be coupled to a rotation coupling portion 422 disposed on a lower end of the connection member 400. The pair of grill-side mounts 370 may be provided as a pair of protruding plates so that the rotation coupling portion 422 may be rotatably coupled thereto. That is, the rotation coupling portion 422 may be inserted between the grill-side mounts 370. Both sides of the rotation coupling portion 422 may be rotatably coupled to the grill-side mount 370.

The panel-side mount 260 may be disposed on each of both sides of the panel 200 so that an upper end of the connection member 400 may be mounted thereon. A plurality of panel-side mounts 260 may be provided so that the panel-side mount 260 may be mounted regardless of a mounting direction of the suction grill 300. That is, the panel-side mount 260 may be disposed on or at a position spaced apart from each of both the first and second sides of the panel 200. For example, four panel-side mounts 260 may be provided.

Thus, the mounting direction of the suction grill 300 may be selected to determine an opening direction of the suction grill 300. That is, when the connection member 400 is mounted on the panel-side mount 260 disposed on a front portion of the panel 200, the suction grill 300 may be opened while rotating using the front portion of the panel 200 as an axis. On the other hand, when the connection member 400 is mounted on the panel-side mount 250 disposed on a rear portion of the panel 200, the suction grill 300 may be opened while rotating using the rear portion of the panel 200 as an axis.

The panel-side mounts 260 disposed on the panel 200 may have a same fundamental structure and shape. Each panel-side mount 260 may include an edge to define a space in which the connection member 400 may be accommodated, a slot 262 defined and inside the edge 261, and restricters 265 and 266 that protrude from both lateral sides of slot 262 to selectively restrict sliding movement of the connection member 400.

The edge 261 may extend upward to define a space in which an end of the connection member 400 may be accommodated and slidable. The edge 261 may have a rectangular shape. That is, the edge 261 may extend along one side of the grill seat 232.

The slot 262 may be defined in a space defined by the edge 261 and opened from a first end of the slot 262 to a second end of the slot 262. The slot 262 may have a width less than a width of the upper end of the connection member 400. Thus, in a state in which the connection member 400 is inserted through the slot 262, the upper end of the connection member 400 may protrude from both sides of the slot 262.

A bottom surface 263 may be disposed on both lateral sides of the slot 262 to contact a contact 412 disposed on each of both lateral sides of the upper end of the connection member 400. The contact 412 may move along the bottom surface 263 when the connection 400 member moves. The bottom surface 263 may be inclined downward so that the contact 412 may be smoothly slidable in contact with the bottom surface 263.

A connection member insertion hole 264 may be defined in one end of the slot 262. The connection member insertion hole 264 may have a size corresponding to or greater than a size of the upper end of the connection member 400 so that the connection member 400 may be inserted through the connection member insertion hole 264.

A first restricter 265 may be disposed on an end of the bottom surface 263 and contact the connection member insertion hole 264. The first restricter 265 may protrude upward to prevent the connection member 400 as it move along the slot 262 from being inserted into the connection member insertion hole 264. That is, the first restricter 265 may protrude upward to prevent the contact 412 from moving toward the connection member insertion hole 264.

A second restricter 266 may be further disposed on one side of the bottom surface 263. The second restricter 266 may protrude upward from the bottom surface 263 corresponding to the contact 412 in a state in which the suction grill 300 is closed. Thus, in the state in which the suction grill 300 is closed, movement of the contact 412 in a direction in which the suction grill 300 is opened may be restricted.

The second restricter 266 may have an inclined surface 267 so that the second restricter 266 has a height that gradually increases away from the first restricter 265. A vertical surface 268 that extends substantially perpendicular to the bottom surface 263 may be disposed on a highest end of the inclined surface 267.

Thus, when the suction grill 300 is closed, the contact 412 of the connection member 400 may move away from the first restricter 265. The contact 412 of the connection member 400 may slidably move over the inclined surface 267 of the second restricter 266. Also, in a state in which the suction grill 300 is fully closed, the contact 412 of the connection member 400 may contact the vertical surface 268 of the second restricter 266 to restrict random slidable movement of the connection member 40. The inclined surface 267 and the vertical surface 268 may be disposed so that they have surfaces that cross each other to more effectively perform sliding movement of the contact 412 and restrict the contact 412.

The connection member 400 may have a bar shape having a predetermined length. The connection member 400 may have a sufficiently long length to maintain a sufficient distance so that the end of the suction grill 300 does not interfere with the panel 200 when the suction grill 300 is fully opened.

In detail, the connection member 400 may include an upper bent portion 410, a lower bent portion 420, and an intermediate connection portion 430. The upper bent portion 410 may be bent upward (when viewed in FIG. 11) with respect to the intermediate connection portion 430, the lower bent portion 420 may be bent downward in a direction opposite to the upper bent portion 410, and the intermediate connection portion 430 may connect the upper bent portion 410 to the lower bent portion 420. The upper bent portion 410 and the lower bent portion 420 may extend at an incline. The upper bent portion 410 may have an inclination greater than an inclination of the lower bent portion 420.

The contact 412 may be disposed on or at an upper end of the upper bent portion 410. The contact 412 may be disposed on both lateral sides of the upper end of the upper bent portion 410 to contact the bottom surface 263 of the panel-side mount 260. The contact 412 may have a roller shape, which is easily slidable. Further, the contact 412 may be rotatably mounted on the upper bent portion 410.

The contact 412 may be mounted to protrude from both sides of the upper bent portion 410 and have a width greater than a width of each of the upper bent portion 410, the intermediate connection portion 430, and the lower bent portion 420. Thus, when the connection member 400 passes through the slot 262 to slidably move, the contact 412 may contact the bottom surface 263 of each of both sides of the slot 262.

The contact 412 may have a diameter greater than a height of the vertical surface 268 of the second restricter 266. Thus, when a user manipulates the suction grill 300 to open the suction grill 300, the contact 412 may move over the vertical surface 268.

The lower bent portion 420 may extend to a lower end of the intermediate connection portion 430. That is, a pair of lateral sides of the lower bent portion 420 may extend so that central portions of the lower bent portion 420 may extend away from each other. Also, the rotation coupling portion 422 may be disposed on each of both sides of the lower end of the lower bent portion 420. The rotation coupling portion 422 may be rotatably shaft-coupled to the grill-side mount 370 disposed on the suction grill 300. Thus, when the suction grill 300 is opened, the suction grill 300 may be rotatable using the rotation coupling portion 422 as an axis.

Hereinafter, opening and closing processes of the suction grill of the indoor device for a cassette type air conditioner including the above-described structure according to embodiments will be described in detail with reference to the accompanying drawings.

Figure 10:
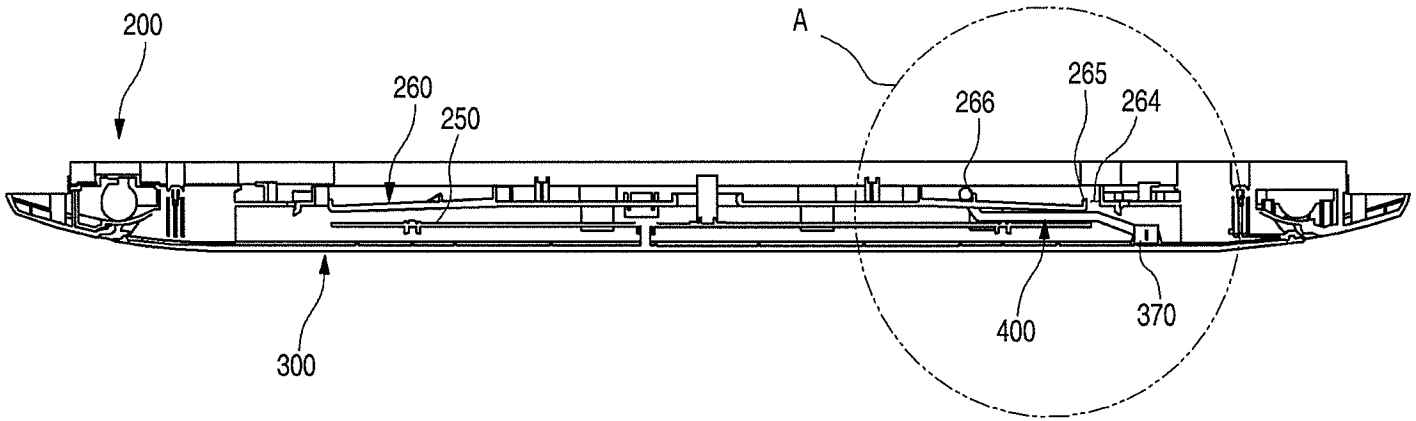
FIG. 10 is a cross-sectional view illustrating a state in which the suction grill is closed according to embodiments.
Figure 11:
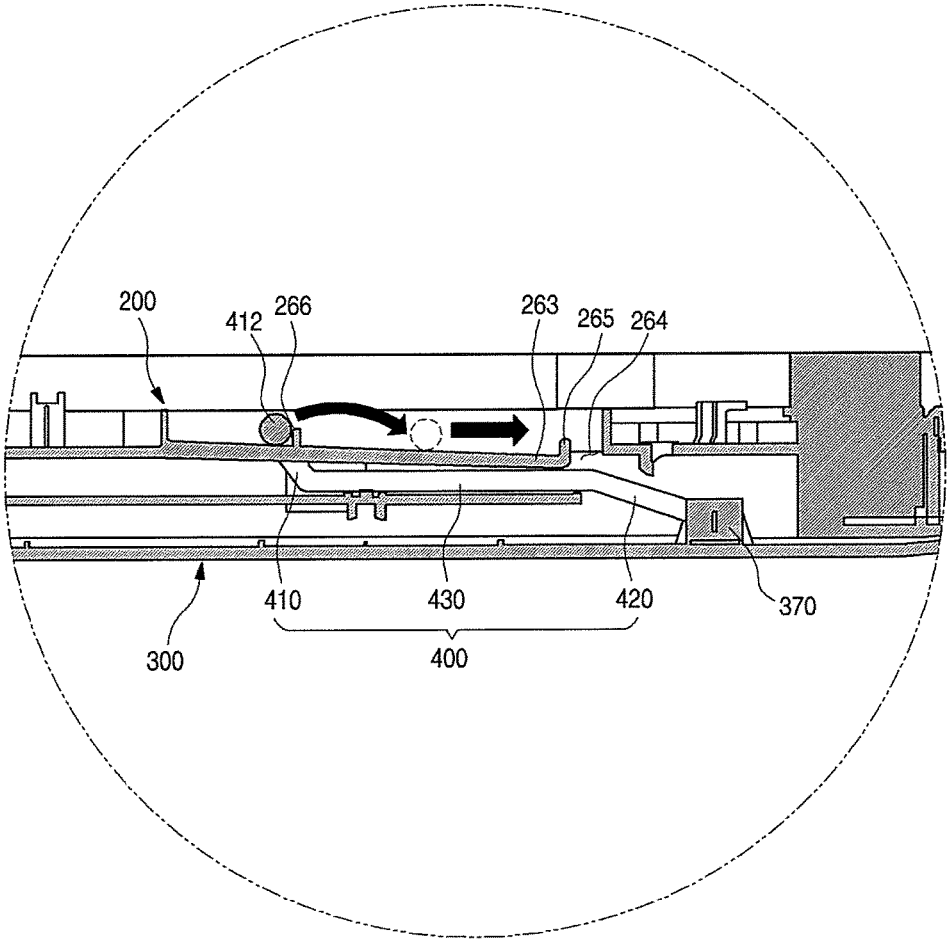
FIG. 11 is an enlarged view of a main portion in a region A of FIG. 10.

FIG. 10 is a cross-sectional view illustrating a state in which the suction grill is closed according to embodiments. FIG. 11 is an enlarged view of a main portion in a region A of FIG. 10.

As illustrated in the drawings, in a state in which the suction grill 300 is mounted on the panel 200 and then fully closed, the bottom surface of the suction grill 300 and a circumference of the bottom surface of the panel 200 may be disposed on a same plane so that the suction grill 300 and the panel 200 have a sense of unity.

Also, the connection member 400 may extend substantially parallel to the suction grill 300, and the contact 412 may be in contact with the vertical surface 268 of the second restricter 266. Thus, the contact 412 may be restricted in movement in one direction by the vertical surface 268.

In this state, the fixing member 330 mounted on the suction grill 300 may be inserted into the panel 200. Thus, the first end of the fixing member 330 may be fixed, and the second end may be restricted with the panel 200 by the switching member 340. Thus, the suction grill 300 may be maintained in the state in which the suction grill 300 is fixedly mounted on the panel 200. In this state, the indoor device 100 may operate.

During use of the indoor device 100, if internal servicing or cleaning of the indoor device 100 is required, or the air filter within the indoor device 100 needs to be exchanged, the suction grill 300 will have to be opened. To open the suction grill 300, the switching member 340 may be manipulated first to allow restriction of the second end of the suction grill 300 to be released from the panel 200. When the suction grill 300 is pulled forward to allow the contact 412 to move away from the second restricter 266, the suction grill 300 may move slightly forward to separate the fixing member 330 from the panel 200. That is, the restriction between the suction grill 300 and the panel 200 may be completely released, and thus, the suction grill 300 may be movable forward or backward.

In this state, when the suction grill 300 is pushed backward, the contact 412 may slidably move over the vertical surface 268 of the second restricter 266. Also, the contact 412 may be smoothly slidable along the inclination of the bottom surface 263. The contact 412 may be smoothly slidable to the first restricter 265 by a weight of the suction grill 300. Simultaneously, the suction grill 300 may be smoothly rotated, and then, may be opened due to the position of the grill seat 232 disposed biased to one side of the suction grill 300.

As described above, the connection member 400 may slidably move to provide a sufficient gap between the panel 200 and the suction grill 300. Thus, when the suction grill 300 rotates to open, the suction grill 300 and the panel 200 may not interfere with each other.

More particularly, the protrusion 320 disposed on an edge of the suction grill 300 may cover the panel 200. However, the panel 200 and the suction grill 300 may be spaced apart from each other by the movement of the connection member 400, as described above, to open the suction grill 300 without interfering with the protrusion 320 even though the suction grill 300 rotates. Further, the suction grill 300 may smoothly slide and rotate just when the contact 412 of the connection member 400 is over the first restricter 265 by the coupling relationship between the connection member 400, the panel 200, and the suction grill 300.

Figure 12:
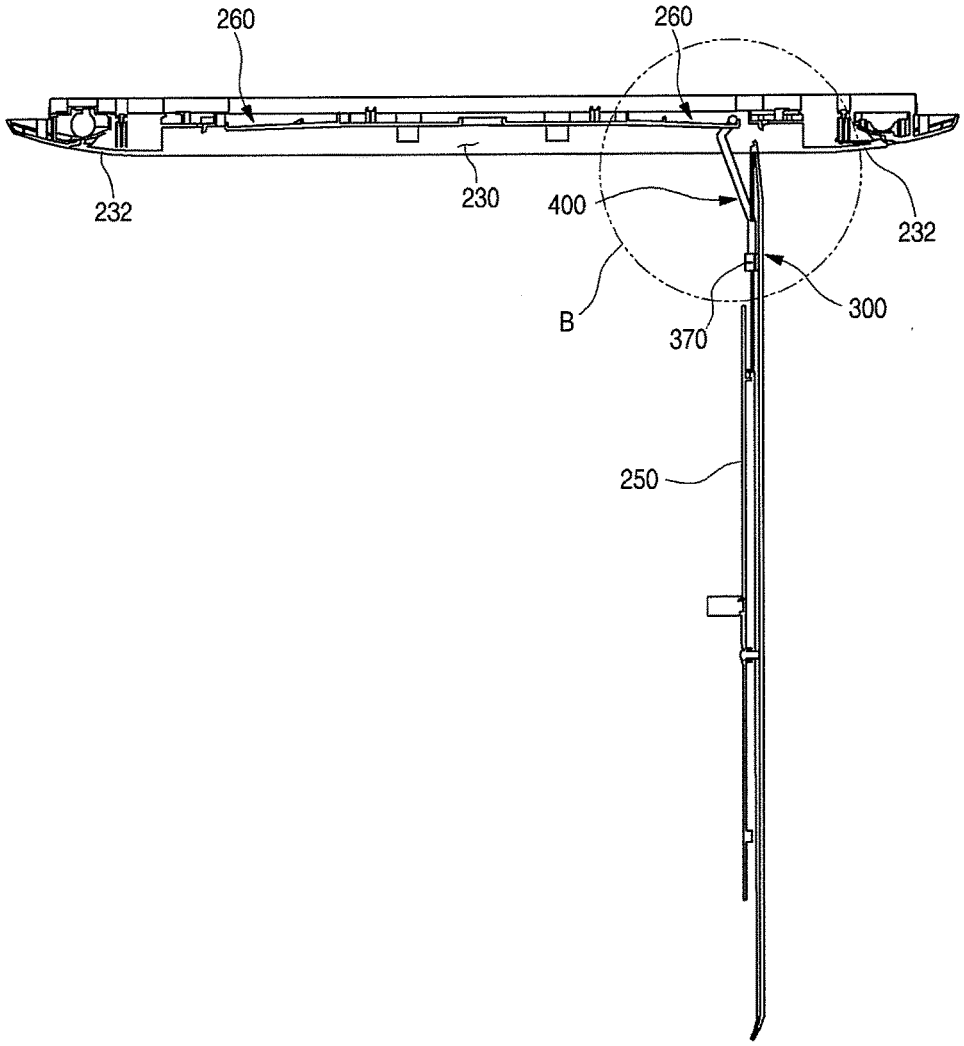
FIG. 12 is a cross-sectional view of a state in which the suction grill is opened according to embodiments.
Figure 13:
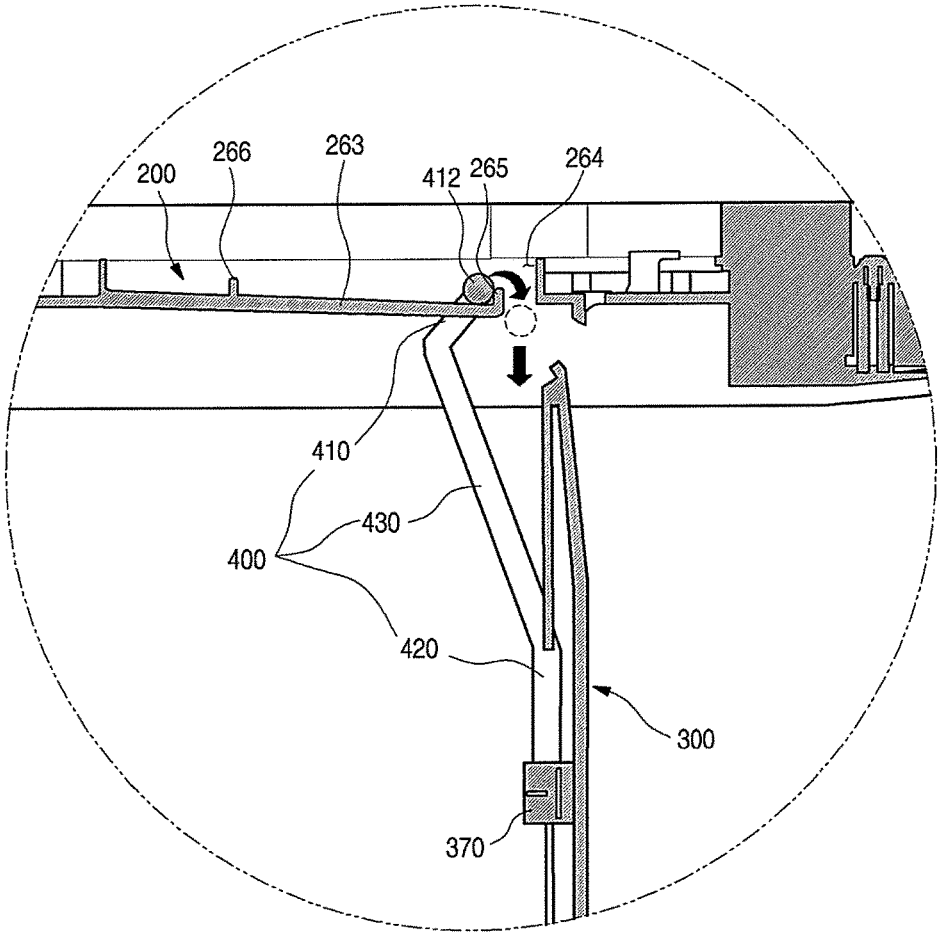
FIG. 13 is an enlarged view of a main portion in a region B of FIG. 12.
Figure 14:
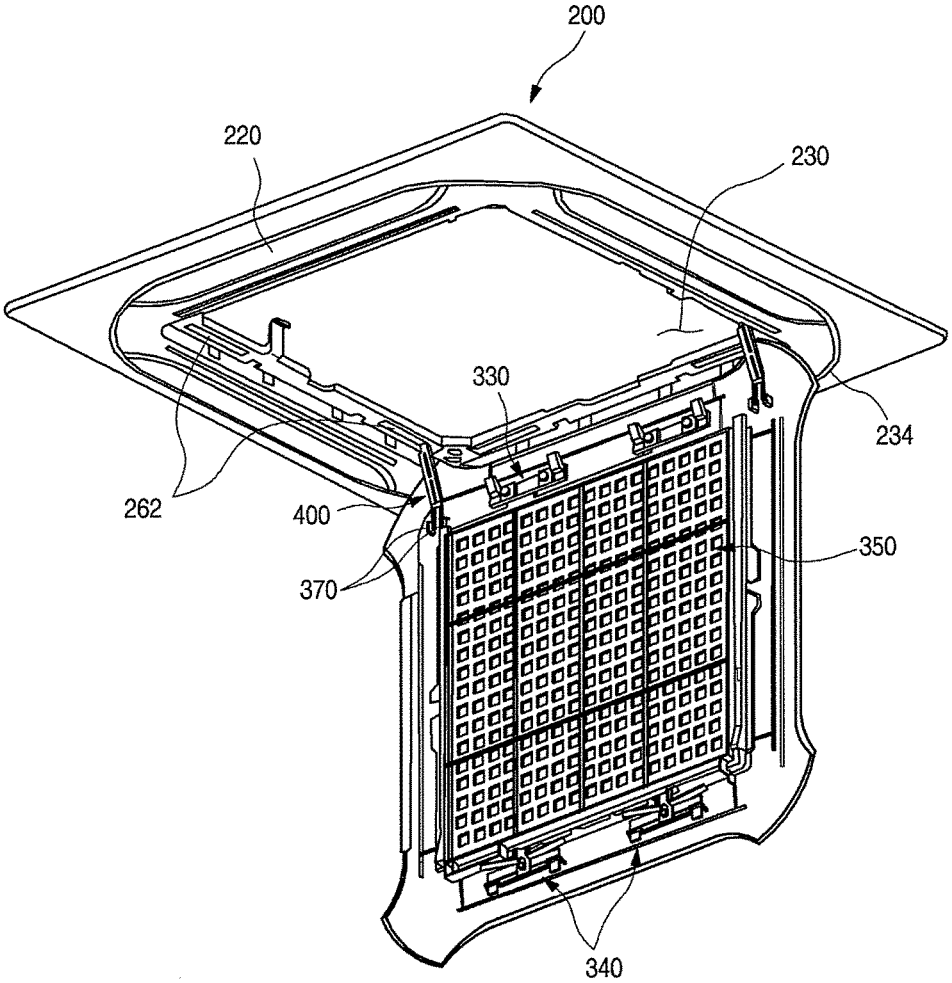
FIG. 14 is a perspective view of the state in which the suction grill is opened according to embodiments.

FIG. 12 is a cross-sectional view of a state in which the suction grill is opened according to embodiments. FIG. 13 is an enlarged view of a main part in a region B of FIG. 12. FIG. 14 is a perspective view of the state in which the suction grill is opened according to embodiments.

As illustrated in the drawings, in a state in which the suction grill 300 is fully opened, the front end of the suction grill may face a lower side, and thus, the back surface of the suction grill 300 may be fully exposed forward. Thus, internal cleaning and servicing operations of the indoor device 100 may be performed, and also, exchanging of the air filter and cleaning of the suction grill 300 may be easily performed.

In the state in which the suction grill 300 is fully opened, the contact 412 may be in contact with the first restricter 265. In this state, the contact part 412 does not further slide by the first restricter 265. Also, the connection member 400 may rotate to face a lower side, and the suction grill 300 may be opened in a direction substantially perpendicular to the panel 200.

In this state, a user may detach the suction grill 300 to separate the suction grill 300 from the panel 200. For this, the user may lift the suction grill 300 upward in a state in which the contact 412 is in contact with the first restricter 265 to allow the contact 412 to be withdrawn through the connection member insertion hole 264 over the first restricter 265, thereby separating the connection member 400 from the panel-side mount 260.

To mount the suction grill 300 on the panel 200 or to open the suction grill 300, the above-described processes may be reversely performed to insert the connection member 400 into the panel-side mount 260. Then, the suction grill 300 may rotate and slide to allow the contact 412 to contact the vertical surface 268 of the second restricter 266. Also, the fixing member 330 and the switching member 340 may restrict the panel 200 to maintain a state in which the suction grill 300 is closed.

Hereinafter, suction and discharge states of air into and from the indoor device for a cassette type air conditioner including the above-described structure according to embodiments will be described.

Figure 15:
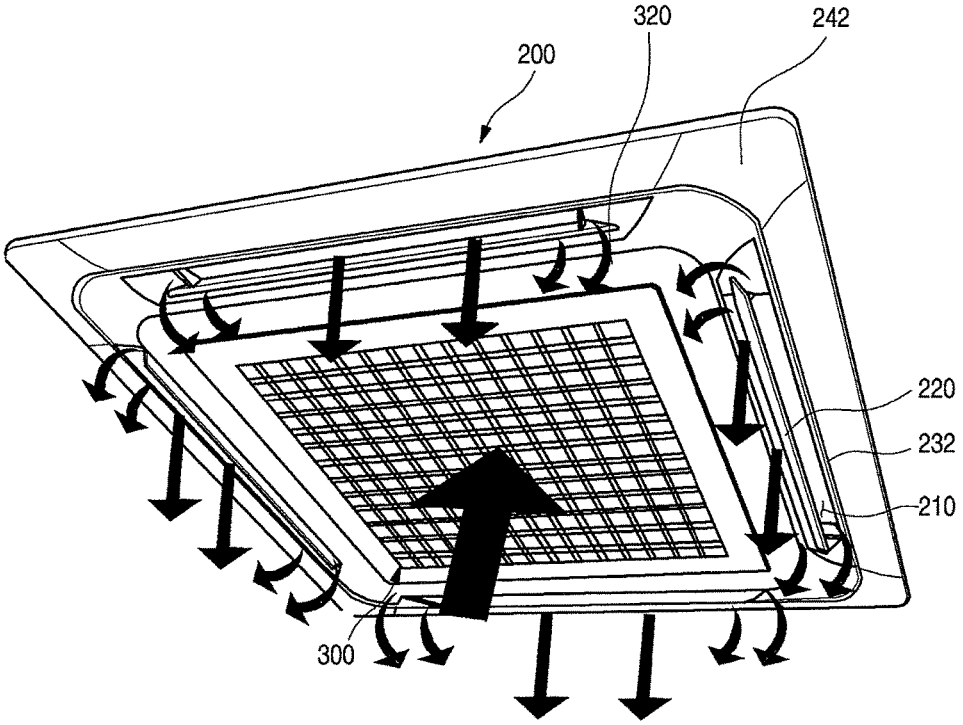
FIG. 15 is a schematic perspective view illustrating an airflow in the panel and the suction grill according to embodiments.
Figure 16:
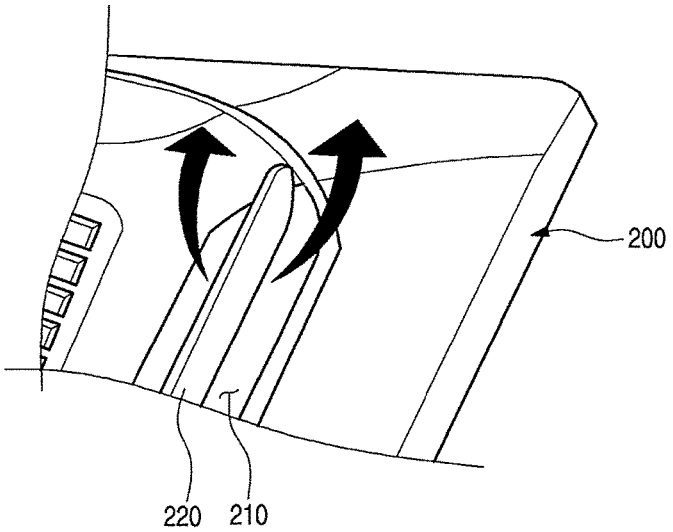
FIG. 16 is a partial perspective view of an air discharge structure in a discharge hole according to embodiments.

FIG. 15 is a schematic perspective view illustrating an airflow in the panel and the suction grill according to embodiments. FIG. 16 is a partial perspective view of an air discharge structure in a discharge hole according to embodiments.

As illustrated in the drawings, when the indoor device 100 operates, indoor air may be suctioned into the indoor device 100 through the suction grill 300. Also, the air may be heat-exchanged within the indoor device 100, and then discharged to the outside through the plurality of discharge holes 210.

When the vanes 220 disposed inside the discharge holes 210 rotate, the discharged air may be directed in a flow direction according to a rotating direction of the vane 220. Thus, the air may be discharged outward from each of the discharge holes 210.

An outer line of the discharge hole(s) 210 may be defined by the rounded groove 234. The rounded groove 234 may have a rounded cross-section. As illustrated in FIG. 15, the discharged air may not flow along an outer surface of the panel 200, but rather, may be discharged into the indoor space. Thus, the discharged air may be supplied into the indoor space without contaminating the panel 200 outside of the discharge hole(s) 210 or the ceiling surface.

Both ends of each discharge hole 210 of the panel 200 may gradually decrease in width outward and be rounded to form a tapered end of the panel 200. Also, a guide member defining an inner surface of the discharge hole 210 may be inclinedly disposed. More particularly, in a case of both ends of the discharge hole 210, the guide member may be rounded toward both ends of the discharge hole 210. Thus, discharged air may be concentrated as a flow of air discharged from both ends of the discharge hole 210 in a central direction to prevent dew from being formed on ends of the discharge hole 210 and an end of the vane 220.

According to embodiments, a suction grill may be mounted to cover a panel. More particularly, the suction grill may extend up to discharge holes of the panel to form an inner line of the discharge holes, thereby providing an elegant exterior. Also, an outer line of the discharge holes and a protrusion of the suction grill may form one closed loop due to a rounded groove to minimize lines generated by connected portions between components, thereby further providing an elegant exterior.

More particularly, the rounded groove defining the outer line of the discharge hole(s) may have a rounded cross-section to allow the discharged air to flow into an indoor space without flowing along the panel. Further, the discharge hole(s) may have a shape that gradually decreases in width outward to allow the discharged air to flow inward without flowing outward, thereby preventing the panel and a ceiling surface from being contaminated by the discharged air.

Also, the suction grill mounted on the panel may be connected by the connection member. Thus, when the suction grill is opened, the suction grill may slidably move downward to prevent the suction grill from interfering with the panel when the suction grill rotates.

Further, when the suction grill is opened, the suction grill may be maintained in the state in which an inner surface of the suction grill is fully opened to face a front side to allow a user to easily perform cleaning and servicing of the suction grill and the air filer.

Furthermore, the suction grill may be previously set in an opening direction according to a mounting direction of the suction grill to mount the suction grill so that the suction grill is opened to a position that is convenient for a user according to as installed position of the indoor unit.

Embodiments disclosed herein provide an indoor unit or device for a cassette type air conditioner which extends so that an outer end of a suction grill defines an inner line of a discharge hole of a panel.

Embodiments disclosed herein also provide an indoor unit or device for a cassette type air conditioner, which is configured to allow a suction grill to be opened while slidably rotating, thereby being opened without interfering with a panel according to a shape of the suction grill.

Embodiments disclosed herein provide an indoor unit or device for a cassette type air conditioner that may include a panel mounted on a ceiling surface of an indoor space to define an exterior of a bottom surface of the indoor unit. The panel may include a suction hole to suction indoor air and a plurality of discharge holes to discharge air into the indoor space; a vane rotatably mounted on each of the discharge holes to adjust a flow direction of the discharged air; and a suction grill mounted outside of the panel to cover the suction hole of the panel. A plurality of concave parts or portions, which may be disposed to match an inner line of the discharge holes, may be disposed on an outer end of the suction grill.

A protrusion that extends between the plurality of discharge holes may be further disposed on an edge of the suction grill. An edge of the suction grill may further protrude from the concave parts.

A rounded groove having a close loop shape that connects an outer line of the discharge holes to an outer line of the vane and an outer line of the protrusions may be defined in the panel. The rounded groove may have a cross-section that is rounded to guide the air discharged from the discharge holes.

Each of both ends of the discharge holes and the vane may have a shape that gradually decreases in width outward.

A grill having a lattice shape in horizontal and vertical directions thereof may be disposed on the suction grill. The grill may have a width that gradually decreases downward.

The grill may include an inclined part or portion having a width that gradually decreases downward, and a vertical part or portion that extends from both sides of an upper end of the inclined part in a direction substantially perpendicular to the ceiling surface.

A groove, which may be recessed to collect dust or foreign substances, may be defined in a top surface of the grill.

The concave parts may contact an inner end of the vane.

An edge of the suction grill may connect outer lines of the vanes, which may be adjacent to each other, to each other.

Embodiment disclosed herein further provide an indoor unit or device for a cassette type air conditioner that may include a cabinet including a heat exchanger and a blower fan; a panel mounted on a bottom surface of the cabinet, the panel including a suction hole in a central portion thereof and a discharge hole outside the suction hole; a suction grill mounted on to cover the suction hole, the suction grill including a concave part or portion having a shape that corresponds to that of an inner line of the discharge hole; and a connection member having both ends, which may be respectively mounted on the panel and the suction grill to connect the panel to the suction grill. The connection member may rotate while horizontally slidably moving to open or close the suction grill.

A panel-side mount part or mount on which the connection member may be slidably mounted may be disposed on each of both left and right sides of the panel, and a grill-side mount part or mount, to which the connection member may be rotatably coupled, may be disposed on each of both left and right sides of the suction grill. The panel-side mount part may be symmetrically provided in a pair on both left and right sides of the panel, and the connection member may be selectively mounted on one side of the panel-side mount part according to an opening direction of the suction grill.

The indoor unit may further include an edge disposed on each of both sides of the panel to define a space to accommodate an upper end of the connection member; a slot opened along a sliding movement direction of the connection member in the edge to guide movement of the connection member; a bottom surface disposed on each of both sides of the slot to support the connection member; and a restriction part or restricter that protrudes from the bottom surface to restrict the movement of the connection member in a state in which the suction grill is closed or opened.

A connection member insertion hole, through which the connection member may be accessible, may be further defined in an end of the slot. The bottom may be inclined downward in a direction in which the connection member moves.

The restriction part may include a first restriction part or restricter disposed on an end of the slot to restrict the movement of the connection member in a state in which the suction grill is fully opened, and a second restriction part or restricter disposed on a side that is spaced apart from the first restriction part to restrict the movement of the connection member in a state where the suction grill is fully closed. The second restriction part may include an inclined surface that is inclined downward in a direction in which the connection member slidably moves when the suction grill is closed, and a vertical surface that extends from an upper end of the inclined surface in a direction substantially perpendicular to the bottom surface.

A fixing member that protrudes backward and inserted into one side of the panel when the suction grill is closed to restrict the suction grill may be disposed on a top surface of the suction grill, which may be adjacent to one side thereof on which the connection member is mounted. A switching member to allow an end of the suction grill to be selectively restricted to the panel according to a user's manipulation may be disposed on one side of the suction grill facing the fixing member.

The connection member may include an upper bent part or portion slidably mounted on the panel; a lower bent part or portion rotatably coupled to the suction grill; and an intermediate connection part or portion that connects the upper bent part to the lower bent part. The upper bent part and the lower bent part may be inclinedly bent in directions opposite to each other.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An indoor device for a cassette type air conditioner, the indoor device comprising:

a panel configured to be mounted in a ceiling of an indoor space to define an exterior of a bottom surface of the indoor device, the panel comprising a suction hole through which indoor air is suctioned into the indoor device, and a plurality of discharge holes to discharge air into the indoor space;

a plurality of vanes rotatably mounted in the plurality of discharge holes, respectively, to adjust a flow direction of the discharged air;

a suction grill mounted on the panel to cover the suction hole; and at least one connection member having first and second ends mounted, respectively, on the panel and the suction grill to connect the panel to the suction grill, wherein the at least one connection member rotates while horizontally slidably moving to open or close the suction grill, wherein in a state in which the suction grill is fully opened, the first and second ends of the at least one connecting member are mounted to the suction grill and the panel, respectively, and the suction grill is suspended by the at least one connecting member and spaced apart from the panel, wherein an outer edge of the suction grill comprises a plurality of concave portions shaped to match, respectively, inner lines of the plurality of discharge holes, wherein the at least one connection member comprises a plurality of connection members provided at first and second lateral sides of the indoor device, wherein a panel-side mount, on which each of the plurality of connection members is slidably mounted, respectively, is disposed on each of first and second lateral sides of the panel, and wherein a grill-side mount to which each of the plurality of connection members is rotatably coupled, respectively, is disposed on each of first and second lateral sides of the suction grill, wherein each panel-side mount comprises:

an edge defined in each of the fir and second lateral sides of the panel to provide a space to accommodate the first end of the respective connection member;

a slot opened along a sliding movement direction of the respective connection member in the edge to guide movement of the respective connection member;

a bottom surface disposed at each of both sides of the slot to support the respective connection member; and a restricter that protrudes from the bottom surface to restrict the movement of the respective connection member in a state in which the suction grill is closed or opened.

2. The indoor device according to claim 1, wherein ends of the plurality of discharge holes and the plurality of vanes have a shape that gradually decreases in width.

3. The indoor device according to claim 1, wherein the plurality of concave portions contact inner sides of the plurality of vanes, respectively.

4. The indoor device according to claim 1, wherein the outer edge of the suction grill connects outer lines of the plurality of vanes, which are adjacent to each other, to each other.

5. The indoor device according to claim 1, wherein the outer edge of the suction grill further comprises a plurality of protrusions that extends, respectively, between the plurality of discharge holes.

6. The indoor device according to claim 5, wherein the panel further comprises a rounded groove having a closed loop shape that connects outer lines of the plurality of discharge holes, the plurality of vanes, and the plurality of protrusions.

7. The indoor device according to claim 6, wherein the rounded groove has a cross-section that is rounded to guide the air discharged from the plurality of discharge holes.

8. The indoor device according to claim 1, wherein the suction grill includes a suction portion, and the suction portion has a lattice shape due to a plurality of bars, which are disposed to cross each other in horizontal and vertical directions.

9. The indoor device according to claim 8, wherein the plurality of bars each has a width that gradually decreases in a downward direction.

10. The indoor device according to claim 8, wherein the plurality of bars each comprises:

an inclined portion having a width that gradually decreases in a downward direction; and a vertical portion that extends from both sides of an upper end of the inclined portion in a direction substantially perpendicular to a surface of the ceiling.

11. The indoor device according to claim 8, wherein a groove, which is recessed to collect dust or foreign substances, is defined in a top surface of each of the plurality of bars.

12. An indoor device of a cassette type air conditioner, the indoor device comprising:

a cabinet comprising a heat exchanger and a blower fan;

a panel mounted on a bottom surface of the cabinet, the panel comprising a suction hole in a central portion thereof and a plurality of discharge holes outside of the suction hole;

a suction grill mounted to cover the suction hole, the suction grill comprising a plurality of concave portions having a shape that corresponds, respectively, to a shape of inner lines of the plurality of discharge holes; and at least one connection member having first and second ends mounted, respectively, on the panel and the suction grill to connect the panel to the suction grill, wherein the at least one connection member rotates while horizontally slidably moving to open or close the suction grill, wherein in a state in which the suction grill is fully opened, the first and second ends of the at least one connecting member are mounted to the suction grill and the panel, respectively, and the suction grill is suspended by the at least one connecting member and spaced apart from the panel, wherein the at least one connection member comprises a plurality of connection members provided at first and second lateral sides of the indoor device, wherein a panel-side mount, on which each of the plurality of connection members is slidably mounted, respectively, is disposed on each of first and second lateral sides of the panel, and wherein a grill-side mount to which each of the plurality of connection members is rotatably coupled, respectively, is disposed on each of first and second lateral sides of the suction grill, wherein each panel-side mount comprises:

an edge defined in each of the first and second lateral sides of the panel to provide a space to accommodate the first end of the respective connection member;

a slot opened along a sliding movement direction of the respective connection member in the edge to guide movement of the respective connection member;

a bottom surface disposed at each of both sides of the slot to support the respective connection member; and a restricter that protrudes from the bottom surface to restrict the movement of the respective connection member in a state in which the suction grill is closed or opened.

13. The indoor device according to claim 12, wherein a pair of the panel-side mounts is symmetrically provided on both of first and second longitudinal sides of the panel, and wherein the plurality of connection members is selectively mounted on one of the pair of the panel-side mounts according to an opening direction of the suction grill.

14. The indoor device according to claim 12, wherein each of the plurality of connection members comprises:

an upper bent portion slidably mounted on the panel;

a lower bent portion rotatably coupled to the suction grill; and an intermediate connection portion that connects the upper bent portion to the lower bent portion, and wherein the upper bent portion is bent upward with respect to the intermediate connection portion, and the lower bent portion is bent downward in a direction opposite to the upper bent portion.

15. The indoor device according to claim 12, wherein a connection member insertion hole, through which the respective connection member is accessible, is further defined at one end of the slot.

16. The indoor device according to claim 15, wherein the bottom surface is inclined downward in a direction to be lowered toward the connection member insertion hole.

17. The indoor device according to claim 12, wherein the restricter comprises:

a first restricter disposed at a first end of the slot to restrict the movement of the respective connection member in a state in which the suction grill is fully opened; and a second restricter disposed at a side of the slot and spaced apart from the first restricter to restrict the movement of the respective connection member in a state in which the suction grill is fully closed.

18. The indoor device according to claim 17, wherein the second restricter comprises:

an inclined surface, which is inclined in a downward direction in which the respective connection member slidably moves when the suction grill is opened; and a vertical surface that extends from an upper end of the inclined surface in a direction substantially perpendicular to the bottom surface, wherein the respective connection member contacts the vertical surface to restrict slidable movement of the connection member in a state in which the suction grill is fully closed.

19. The indoor device according to claim 12, wherein at least one fixing member, which protrudes in a backward direction and is inserted into the panel when the suction grill is closed to restrict movement of the suction grill, is disposed on a top surface of the suction grill.

20. The indoor device according to claim 19, wherein at least one switching member to allow an end of the suction grill to be selectively coupled to or released from the panel according to a user's manipulation is disposed on a side of the suction grill that faces the at least one fixing member.

21. An indoor device for an air conditioner, the indoor device comprising:

a case in which are disposed a heat exchanger and a fan;

a panel disposed at a bottom of the case, wherein the case is configured to be mounted in a ceiling of an indoor space with the panel viewable to a user, the panel comprising a suction hole disposed at a central portion of the panel and a plurality of discharge holes that extends along edges of the panel between the suction hole and an outer edge of the panel;

a plurality of vanes rotatably mounted in the plurality of discharge holes, respectively, to adjust a flow direction of the discharged air;

a suction grill mounted on the panel to cover the suction hole; and at least one connection member having first and second ends mounted, respectively, on the panel and the suction grill to connect the panel to the suction grill, wherein the at least one connection member rotates while horizontally slidably moving to open or close the suction grill, wherein in a state in which the suction grill is fully opened, the first and second ends of the at least one connecting member are mounted to the suction grill and the panel, respectively, and the suction grill is suspended by the at least one connecting member and spaced apart from the panel, wherein an outer edge of the suction grill comprises a plurality of concave portions disposed to correspond, respectively, to inner lines of the plurality of discharge holes and a plurality of protrusions disposed between the plurality of discharge holes, wherein the panel further comprises a rounded groove having a closed loop shape that connects outer lines of the plurality of discharge holes, the plurality of vanes, and the plurality of protrusions, wherein the at least one connection member comprises:

an upper bent portion slidably mounted on the panel;

a lower bent portion rotatably coupled to the suction grill; and an intermediate connection portion that connects the upper bent portion to the lower bent portion, and wherein the upper bent portion is bent upward with respect to the intermediate connection portion, and the lower bent portion is bent downward in a direction opposite to the upper bent portion.

22. The indoor device according to claim 21, wherein the rounded groove has a cross-section that is rounded to guide the air discharged from the plurality of discharge holes.

23. The indoor device according to claim 21, wherein ends of the plurality of discharge holes and the plurality of vanes have a shape that gradually decreases in width.

24. The indoor device according to claim 21, wherein the plurality of concave portions contact inner sides of the plurality of vanes, respectively.

25. The indoor device according to claim 21, wherein the outer edge of the suction grill connects outer lines of the plurality of vanes, which are adjacent to each other, to each other.

26. The indoor device according to claim 21, wherein the suction grill is rotatably mounted on the panel so as to provide selective opening and closing of the suction hole.

* * * * *